US007535431B2

(12) United States Patent
Rowell

(10) Patent No.: US 7,535,431 B2
(45) Date of Patent: May 19, 2009

(54) ANTENNA SYSTEMS WITH GROUND PLANE EXTENSIONS AND METHOD FOR USE THEREOF

(75) Inventor: Corbett Rowell, New Territories (CN)

(73) Assignee: Hong Kong Applied Science and Technology Research Institute Co., Ltd., Hong Kong (CN)

( * ) Notice: Subject to any disclaimer, the term of this patent is extended or adjusted under 35 U.S.C. 154(b) by 337 days.

(21) Appl. No.: 11/529,777

(22) Filed: Sep. 28, 2006

(65) Prior Publication Data

US 2008/0079635 A1 Apr. 3, 2008

(51) Int. Cl.
*H01Q 1/48* (2006.01)

(52) U.S. Cl. ..... 343/846

(58) Field of Classification Search ..... 343/846, 343/700 MS, 702

See application file for complete search history.

(56) References Cited

U.S. PATENT DOCUMENTS

| | | | | |
|---|---|---|---|---|
| 5,828,340 | A * | 10/1998 | Johnson | 343/700 MS |
| 7,116,276 | B2 * | 10/2006 | Lee | 343/700 MS |
| 7,196,626 | B2 * | 3/2007 | Chen et al. | 340/572.7 |
| 7,202,819 | B2 * | 4/2007 | Hatch | 343/700 MS |
| 7,345,633 | B2 * | 3/2008 | Wielsma | 343/700 MS |
| 2002/0053994 | A1 | 5/2002 | McCorkle | |
| 2002/0122010 | A1 | 9/2002 | McCorkle | |
| 2004/0001029 | A1 * | 1/2004 | Parsche et al. | 343/866 |
| 2004/0125032 | A1 | 7/2004 | Ikuta et al. | |
| 2005/0001770 | A1 | 1/2005 | Ikuta et al. | |
| 2005/0156787 | A1 | 7/2005 | Myoung et al. | |
| 2005/0156788 | A1 | 7/2005 | Lin | |

FOREIGN PATENT DOCUMENTS

| | | |
|---|---|---|
| CN | 1599129 | 3/2005 |
| EP | 1469551 | 10/2004 |
| JP | 2005192183 | 7/2005 |
| WO | WO02093690 | 11/2002 |
| WO | WO03077360 | 9/2003 |
| WO | WO-2005/062422 | 7/2005 |

OTHER PUBLICATIONS

International Search Report issued for PCT/CN2007/070456, dated Oct. 18, 2007; 4 pages.

* cited by examiner

*Primary Examiner*—Huedung Mancuso
(74) *Attorney, Agent, or Firm*—Fulbright & Jaworski L.L.P.

(57) ABSTRACT

An antenna system comprising a ground plane structure on a substrate, an antenna space on the substrate adjacent to the ground plane structure, the antenna space including an ungrounded antenna therein with an associated first resonant length, an extension of the ground plane projecting into the antenna space, the ground plane extension defining a second resonant length that includes at least part of its own length and at least part of a length of the ground plane structure.

15 Claims, 5 Drawing Sheets

ANTENNA SYSTEMS WITH GROUND PLANE EXTENSIONS AND METHOD FOR USE THEREOF

TECHNICAL FIELD

This description relates, in general, to antenna systems and methods, and more specifically, to antenna systems and methods that utilize ground plane resonance.

BACKGROUND OF THE INVENTION

Many antenna systems inside modern wireless devices include one or more antenna elements and a ground plane. Often, a ground plane is a portion of conductive material that is large in surface area when compared to the antenna elements. Further, the ground plane is generally connected to various electronic components through their ground connections. An example ground plane use is to complete a monopole antenna, which is fed against the ground plane and acts like a half-wavelength dipole antenna.

Some prior art systems, such as that shown in PCT Publication No. W02003077360, have one or more parasitic elements extending from the ground plane. Those parasitic elements couple with one or more antenna elements so that each parasitic adds its own narrow frequency band when excited. That the parasitic elements are configured to extend from the ground plane is merely a way to ground the parasitics, and the resonant lengths of such parasitics do not include any part of the ground plane. Another prior art use for extensions from ground planes is to provide baluns for differential antenna elements.

While some amount of coupling between antenna elements and the ground plane in a device results in ground plane radiation, no design currently uses the ground plane as a radiating structure in its own right. In fact, ground plane resonance is usually a phenomenon to be minimized. Thus, when engineers design antenna systems for use in devices, they focus on the volume that is reserved for the antenna elements. Therefore, it is generally true that in a given PCB-mounted antenna system, less than half of the volume in the design is utilized for signal radiation.

BRIEF SUMMARY OF THE INVENTION

Various embodiments of the present invention are directed to antenna systems and methods for use thereof, wherein the antenna systems include one or more ground plane extensions. In one example, an antenna system is disposed on a substrate, such as a PCB, and a ground plane includes a conductive layer that covers most of the surface area of one side. Part of the surface area of the substrate is reserved for an ungrounded antenna that is also disposed on the substrate. The ground plane has a portion that extends into the antenna space. The extension is designed such that at least a portion of its length and at least a portion of the length of the ground plane together form a resonant length that corresponds to a communication band. When in operation, the structure formed from the ground plane and its extension electromagnetically couple with the ungrounded antenna element and transmits data in the communication band. Accordingly, in this example, the ground plane and its extension are used as a radiating structure to add performance in one or more communication bands in addition to communication bands offered by the antenna element.

In a specific example, the antenna element is an ungrounded, monopole-type antenna that is set to one side of the antenna space. The ground plane extension protrudes onto the opposite side of the antenna space. The distance between the antenna element and the ground plane extension is small enough such that capacitive feeding occurs but large enough such that the presence of the ground pane does not narrow the bandwidth of the antenna element to an undesirable degree.

In an example method, a signal is provided to an ungrounded antenna element. Coupling between the ungrounded antenna element and a structure that includes a ground plane and a ground plane extension causes the structure to resonate, thereby transmitting data in an established communication band.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE INVENTION

Figure 1:
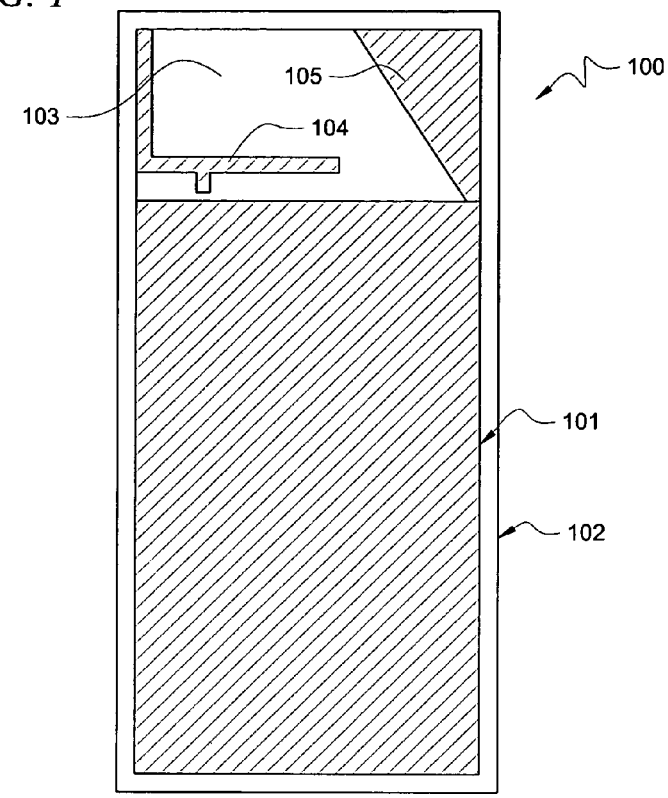
FIG. 1 is an illustration of an exemplary system adapted according to one embodiment of the invention.

FIG. 1 is an illustration of exemplary system 100 adapted according to one embodiment of the invention. System 100 is an antenna system for multi-band and/or broadband communications. System 100 includes ground plane 101 disposed upon substrate 102. Antenna space 103, in this example, is a portion of the substrate that is reserved for antenna element 104, and is, in effect, defined by the shape of ground plane 101.

Antenna element 104 is disposed in antenna space 103. Since antenna 104 is adjacent to, rather than above, ground plane 101 and also does not have a conductive connection to ground plane 101, it is an ungrounded antenna element. Specifically, antenna element 104 is shown in this example as a monopole antenna element.

Projection 105 is an extension of ground plane 101 that is disposed in antenna space 103. Ground plane extension 105 can be part of the same conductive layer that forms ground plane 101 or can be independently formed or disposed on substrate 102. The dimensions of ground plane extension 105 and ground plane 101 together form a resonant length that can be used to transmit data signals. Specifically, when ground plane 101 and ground plane extension 105 are placed within the near field of antenna element 104, antenna element 104 can be operated as a capacitive feed that causes resonance along the resonant length described above. In other words, ground plane extension 105 is designed to adapt a length of a portion of ground plane 101 to conform to a resonant length that corresponds to an established communication band. In this way, the resonance of ground plane 101 can be optimized to provide additional performance to antenna system 100.

Figure 2:
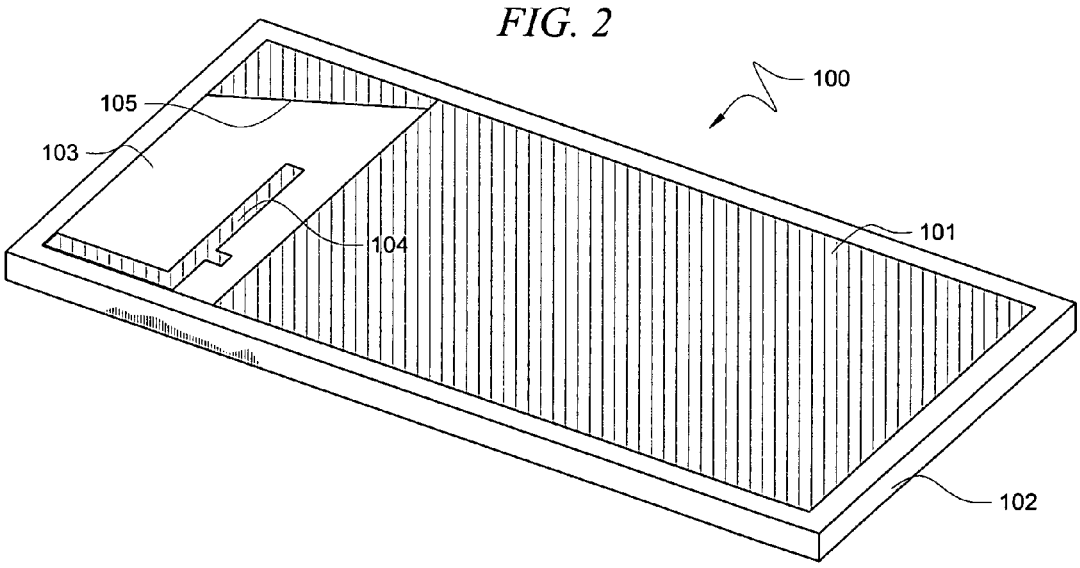
FIG. 2 is an illustration of the exemplary system of FIG. 1 from a different view.

FIG. 2 is an illustration of system 100 from a different view. FIG. 2 shows that substrate 102 is three-dimensional and can be made up of layers. In fact, the view shown in FIG. 2 is somewhat simplified, as various embodiments may use substrate 102 to host a variety of electronic components (not shown), and the items shown on the surface of substrate 102 are not limited to the top layer as some embodiments may include those items in intermediate layers. An example of a suitable type of substrate is a Printed Circuit Board (PCB), where antenna element 104, ground plane 101, and ground plane extension 105 are formed thereon as metallic layers.

Substrate 102 is not limited to a single piece of substrate in various embodiments. In fact, substrate 102 can be made of two or more substrate portions, for example, with ground plane 101 disposed on one portion and antenna area 103 disposed on another portion and ground plane extension 105 connected to ground plane 101 through, for example, a soldered connection.

Figure 3:
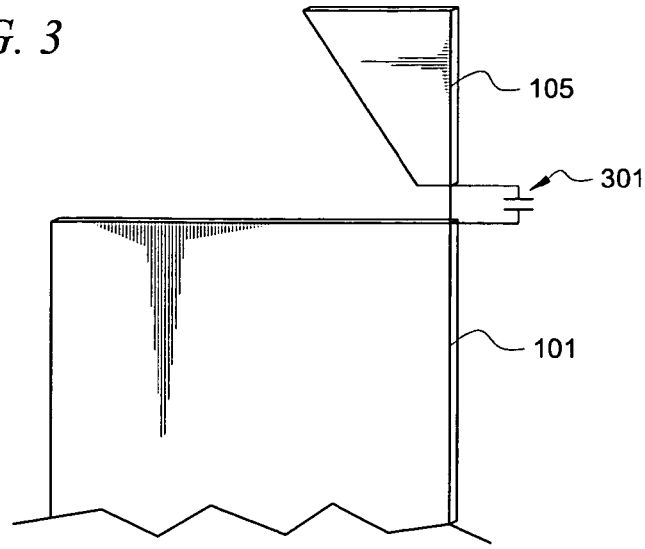
FIG. 3 is an illustration of an exemplary technique for connecting a ground plane extension to a ground plane according to one embodiment of the invention.

FIG. 3 is an illustration of an exemplary technique for connecting ground plane extension 105 to ground plane 101. While it is possible to form ground plane 101 and extension 105 to be continuous, it is also possible to form such features to be separated by a gap. When ground plane 101 and extension 105 are separated by a gap, various techniques exist to make a connection therebetween. As shown in FIG. 3, ground plane extension 105 can be connected to ground plane 101 through lumped element 301 (e.g., a capacitor or inductive/capacitive element). Lumped element 301 provides additional matching and can tune the resonant frequency. Other techniques include, but are not limited to a trace, a soldered wire, and the like.

Figure 4:
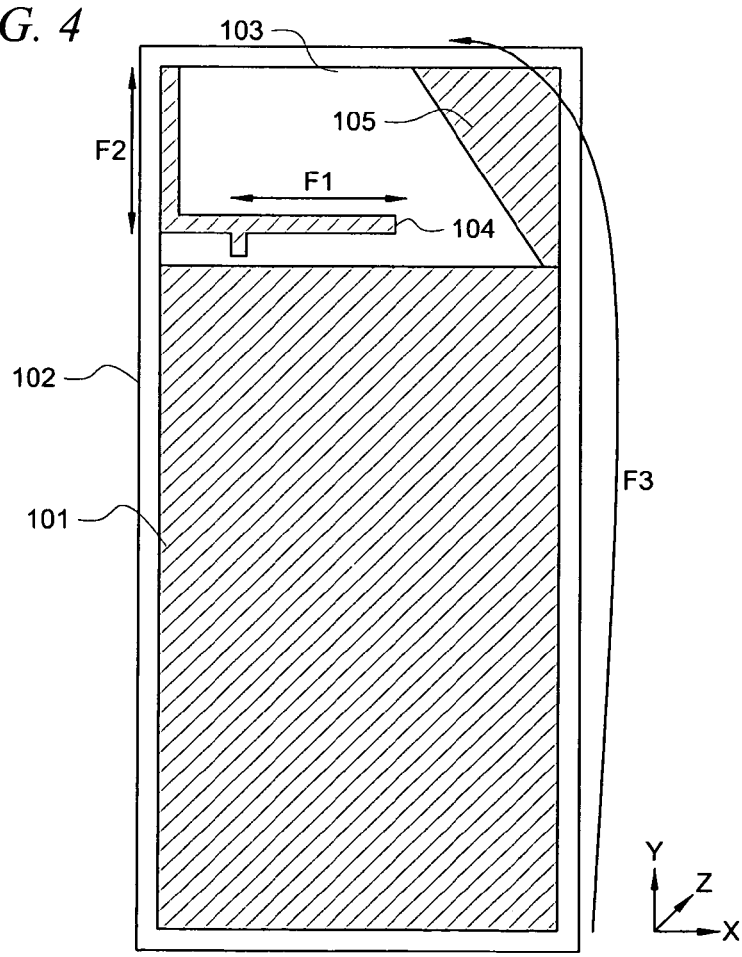
FIG. 4 is an illustration of an exemplary system according to one embodiment of the invention with example resonant lengths marked.

FIG. 4 is an illustration of system 100 with example resonant lengths marked. In this particular example, antenna element 104 is "L" shaped, with the horizontal part of a first resonant length that corresponds to a first frequency band, f1, and the vertical part of a second resonant length that corresponds to a second frequency band, f2. The perpendicular shape of antenna element 104 minimizes coupling between the f1 and f2 bands.

In this example, the proximity of the tip of the horizontal portion of antenna element 104 to extension 105 determines, at least in part, the amount of electromagnetic coupling that occurs between element 104 and the resonant structure formed by ground plane 101 and extension 105. Generally, the greater the distance, the less the coupling, and as coupling between a ground and an antenna increases, the bandwidth of antenna 104 is narrowed. Thus, while it is desirable to minimize coupling to some extent, some amount of coupling is desirable for the capacitive feeding to occur. Similarly, the horizontal orientation of this portion of antenna element 104 reduces coupling since it is substantially orthogonal to the resonant length corresponding the f3 band.

As shown, the length along the outside of the structure formed by ground plane 101 and extension 105 provides a third resonant length that corresponds to a frequency band f3 that is lower than either f1 or f2. In this example, the width at the top of extension 105 affects the resonant length such that a wider top portion lowers frequency band f3. The width at the bottom of extension 105, like the length of the horizontal portion of element 104, affects coupling between antenna element 104 and extension 105.

Figure 5:
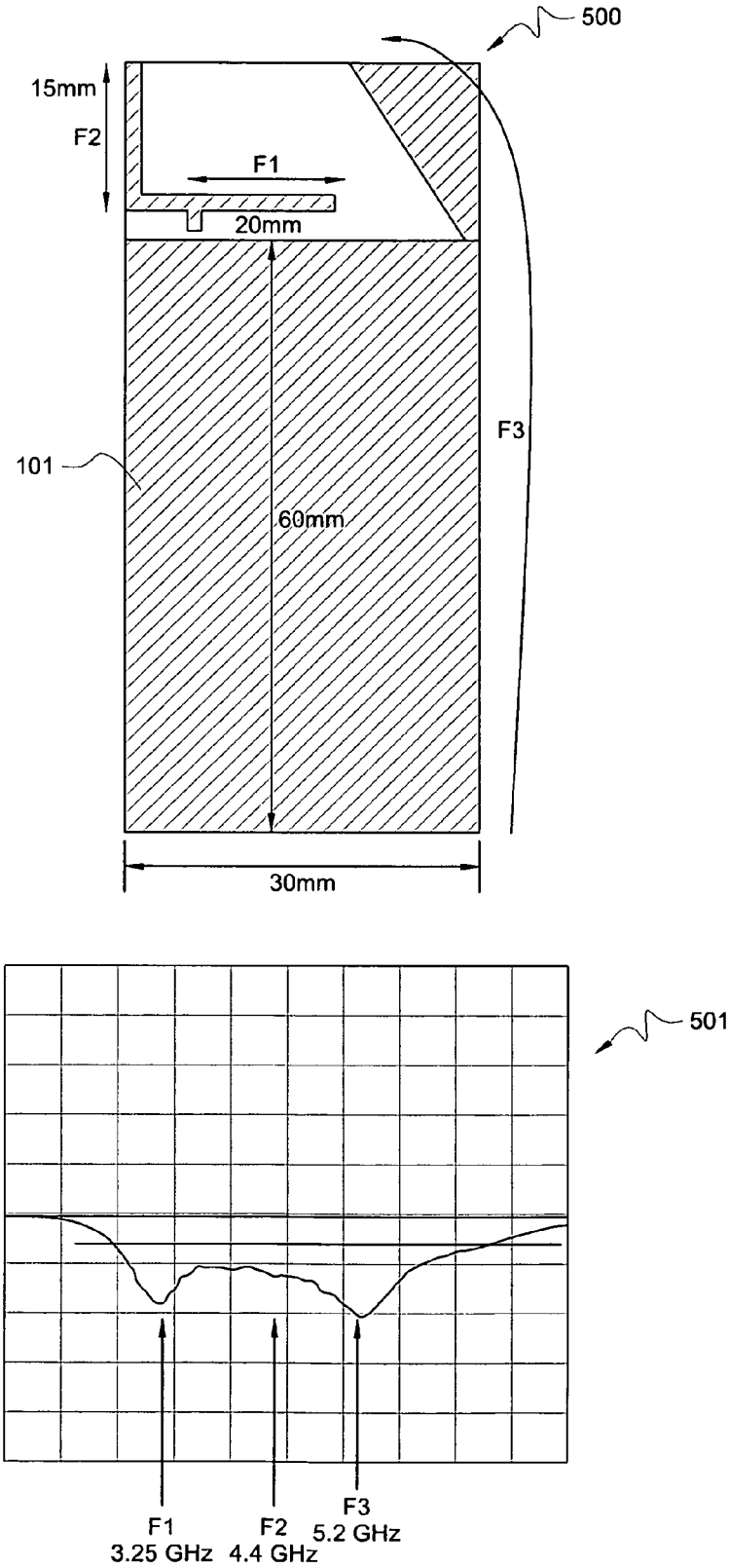
FIG. 5 is an illustration of an exemplary system adapted according to one embodiment of the invention.

FIG. 5 is an illustration of exemplary system 500 adapted according to one embodiment of the invention. System 500 includes dimensions for some features to aid in understanding the operation of a specific embodiment. The dimensions are approximately drawn to scale so that the width at the top and the bottom of the ground plane extension can be inferred within a reasonable degree of certainty. Also included in FIG. 5 is frequency response graph 501 showing performance of system 500 in the RF spectrum starting below 3 GHz and extending above 6 GHz, which corresponds to a significant portion of the Ultra Wide Band (UWB) spectrum in some regions. As in nearly all antennas, the frequency response is dependent upon the resonant lengths of the various elements, and response graph 501 shows that the dimensions of an antenna adapted according to one or more embodiments of the invention can be designed to provide communication in a wide frequency band by overlapping f1, f2, and f3 bands. In other embodiments, system 500 can be designed with other dimensions to provide communication in two or more distinct bands.

Figure 6A:
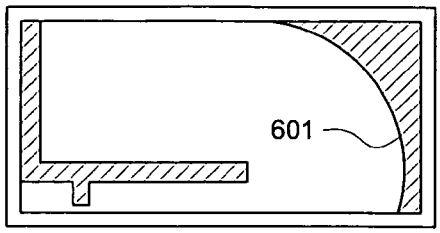
FIGS. 6A and 6B are illustrations of exemplary shapes for ground plane extensions according to various embodiments of the invention.
Figure 6B:
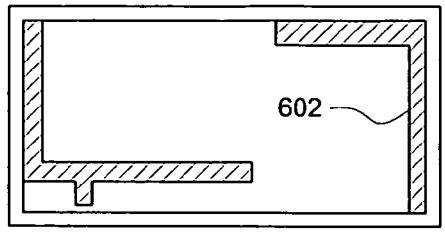
Figure 7A:
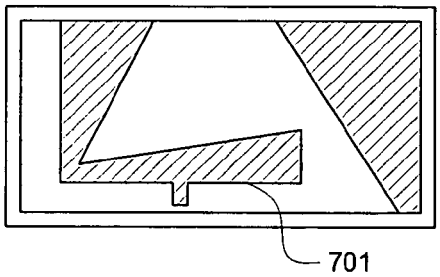
FIGS. 7A-D are illustrations of exemplary shapes for antenna elements according to various embodiments of the invention.
Figure 7B:
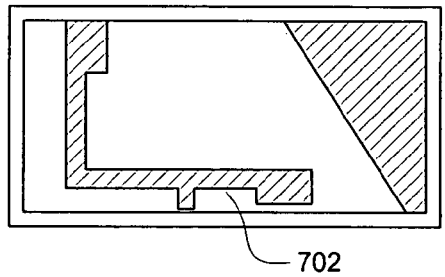
Figure 7C:
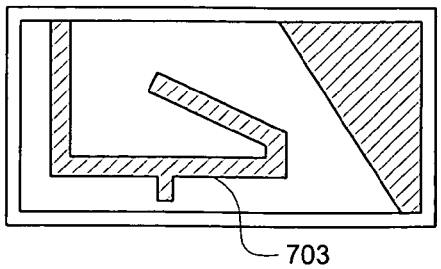
Figure 7D:
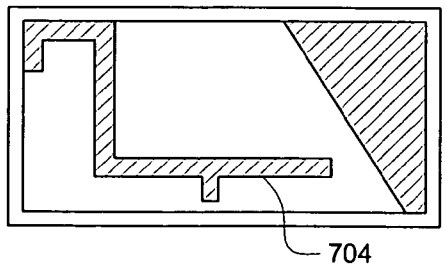

The dimensions in FIG. 5 are for example only, and while system 500 is shown with specific dimensions and shapes, various embodiments of the invention are not limited thereto. In fact, a wide variety of shapes and configurations are possible. FIGS. 6A and 6B are illustrations of exemplary shapes for ground plane extensions 601 and 602. For instance, ground plane extension 601 is similar to extension 105 (FIG. 1), but its inside surface is curved to reduce coupling and amount of material. Extension 602 is "7" shaped and further reduces coupling and materials.

Figure 8:
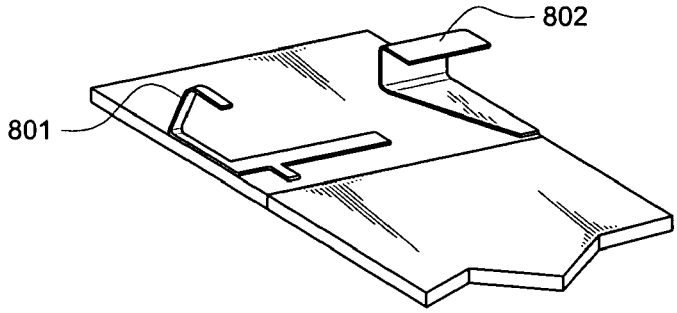
FIG. 8 is an illustration of an exemplary three-dimensional geometry according to one embodiment of the invention.
Figure 9:
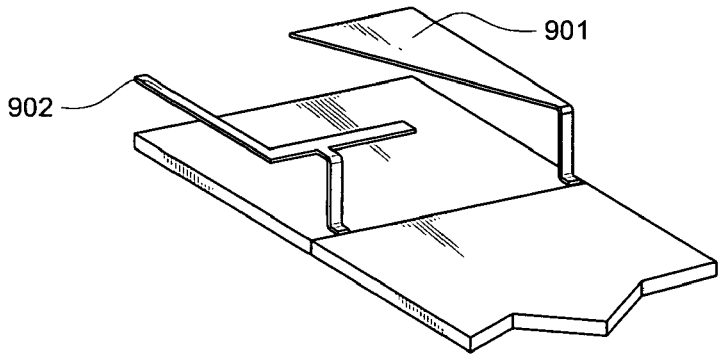
FIG. 9 is an illustration of a raised geometry according to one embodiment of the invention.

FIGS. 7A-D are illustrations of exemplary shapes for antenna elements 701-704. As shown the widths and lengths of the portions of elements 701-704 can vary greatly. Generally, as the length of a portion increases, so does its resonant length. Further, as the width increases, so does capacitive loading in general. Capacitive loading usually affects the electric field distribution of the antenna, making the antenna's electrical length longer for the overall physical dimensions, thereby lowering the resonant frequency(s) of the antenna. Still further, three-dimensional geometries can be adopted in some embodiments. For instance, while the previous examples have shown planar geometries for the antenna element and ground plane extension, it is possible to include bends in one or both to, for example, conform to volume constraints. FIG. 8 is an illustration of exemplary three-dimensional geometry wherein portions of both antenna element 801 and ground plane extension 802 are bent so that one or more portions are not coplanar with the substrate. FIG. 9 is an illustration of a raised geometry wherein both ground plane extension 901 and antenna element 902 are raised above the substrate. In addition to the geometries mentioned above, other characteristics, such as antenna position and signal feed placement can also be modified in some embodiments.

Figure 10:
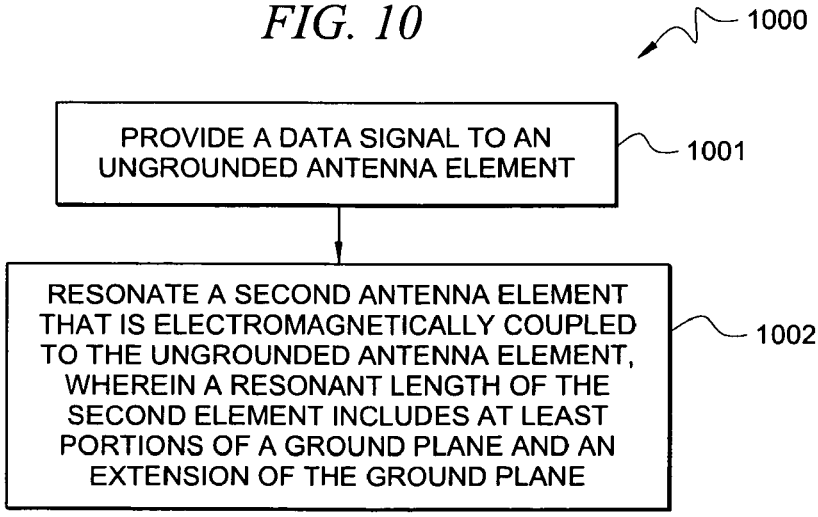
FIG. 10 is an illustration of an exemplary method adapted according to one embodiment of the invention for operating an antenna system.

FIG. 10 is an illustration of exemplary method 1000 adapted according to one embodiment of the invention for operating an antenna system. Method 1000 may be performed, for example, by a cellular telephone, Personal Digital Assistant (PDA), laptop computer, or other kind of communication device. In step 1001, a data signal is provided to an ungrounded antenna element. The data signal may contain, for example, digital or analog information modulated using one or more carrier waves in the RF spectrum. In one example, the ungrounded antenna is disposed on a PCB substrate, and the signal is provided to the ungrounded antenna element through a signal feed from a RF module that encodes and modulates the data. The RF module may or may not also be mounted on the same substrate.

In step 1002, a second element electromagnetically coupled to the ungrounded antenna element is resonated, thereby transmitting data in an established communication band, wherein a resonant length of the second element includes at least portions of a ground plane and a projecting member of the ground plane. In other words, coupling with the ungrounded antenna element causes the structure formed by a ground plane and its extension to resonate at its native frequency, thereby transmitting the data. In this example, the data signal of step 1001 includes data at a frequency that corresponds to the native frequency of the structure formed by the ground plane and its extension.

In this way, the ground plane of the antenna system is optimized to resonate at a frequency that corresponds to an established communication band, thereby adding at least one frequency band to the antenna system. This can be utilized to create a system that provides performance over a plurality of bands. A particular example is the UWB spectrum that includes bands from 3.1 GHz to 10.6 GHz in the United States (and other bands in various countries). UWB performance can be facilitated, at least in part, by some embodiments of the invention which provide broadband communications from both an ungrounded antenna element and from the ground plane so that operation over a wider spectrum is achieved.

Other applications of various embodiments include providing antenna systems for wireless networking, e.g., for IEEE 802.11, or for advanced cellular handsets that use, e.g., various Global Systems for Mobile Communications (GSM) bands. In fact, because of the increased spectrum provided by optimizing the ground plane resonance with a ground plane extension, various embodiments can find use in a variety of high data rate communications applications now known or later developed.

Additional advantages of some embodiments include relatively cost-efficient production, especially in PCB designs, since the ground plane extension can be created with few extra steps (if any). In some embodiments, manufacturing a ground plane extension requires only etching a ground plane shape that includes a projection. Some embodiments are manufactured using other steps such as, for example, mounting a lumped element or soldering a connection between the ground plane and its extension.

Other advantages of some embodiments include increasing the number and/or size of radiating structures in an antenna system while incurring minimal increases in design volume. For instance, in some designs that include both a ground plane and a reserved antenna space, the extension can be disposed on the antenna space, thereby requiring a negligible difference in volume over that of a similar design without an ground plane extension.

A further advantage of some embodiments is apparent when compared to prior art antenna systems that use ground plane extensions as parasitic elements. In those prior art embodiments, a parasitic element extends from a ground plane and provides an extra resonance to the antenna system. The resonant length is due to the length of the parasitic only, such that the added resonance is the parasitic element's own resonance and tends to be quite narrow. However, various embodiments of the invention use a ground plane extension to create a resonant length that includes at least a portion of the length of the extension and a portion of the length of the ground plane, thereby using the ground plane plus its extension as a radiating structure. Typically, the result is that the added band is lower in frequency and much wider than a band added by a parasitic extension.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. An antenna system comprising:

a ground plane structure on a substrate;

an antenna space on said substrate adjacent to said ground plane structure, said antenna space including an ungrounded antenna therein with an associated first resonant and an extension of said ground plane projecting into said antenna space, said ground plane extension defining a second resonant length that includes at least part of its own length and at least part of a length of said ground plane structure, wherein said ground plane extension is coupled to said ground plane through a lumped element.

2. The system of claim 1 wherein said second resonant length corresponds to a communication band.

3. The system of claim 1 wherein said second resonant length corresponds to a band within a spectrum extending from 3.1 GHz to 10.6 GHz.

4. The system of claim 1 wherein said substrate comprises at least a first and a second Printed Circuit Board (PCB), said ground plane disposed on said first PCB and said antenna space on said second PCB.

5. The system of claim 1 wherein said ungrounded antenna is a monopole antenna with a signal feed through said substrate.

6. The system of claim 1 wherein said antenna and said ground plane are coplanar.

7. The system of claim 1 wherein a width of said ground plane extension increases as a distance from said ground plane increases.

8. The system of claim 7 wherein said ungrounded antenna element is an L-shaped monopole antenna element oriented to minimize coupling with said ground plane extension.

9. The system of claim 1 wherein said ungrounded antenna element and said ground plane extension are oriented so as to minimize coupling therebetween.

10. An antenna system comprising:

a planar substrate;

a ground plane structure disposed on a side of said substrate and covering most of said surface area of said side; and an area adjacent to said ground plane structure, said adjacent area including;

an ungrounded antenna element disposed to one side of said adjacent area; and an extension of said ground plane disposed to an opposite side of said adjacent area, said ground plane extension and said ground plane together defining a resonant length that corresponds to a data communication band, said resonant length adapted to electromagnetically couple to said ungrounded antenna element.

11. The system of claim 10 wherein said second resonant length and said first resonant length each correspond to an established communication band.

12. The system of claim 11 wherein said first and second resonant lengths correspond to at least part of the Ultra Wide Band (UWB) spectrum.

13. The system of claim 12 wherein said ground plane extension is shaped so that it width increases as the distance from the ground plane increases, and wherein said ungrounded antenna element is L-shaped monopole antenna element oriented so that a portion thereof that is substantially orthogonal to said resonant length is opposite a narrower portion of said ground plane extension.

14. The system of claim 10 wherein said ground plane extension has a basic shape selected from the list consisting of:

a triangle; and a trapezoid.

15. The system of claim 10 further comprising:

a lumped element connecting said ground plane extension to said ground plane.

* * * * *